US012679635B2

(12) United States Patent
Ma et al.

(10) Patent No.: US 12,679,635 B2
(45) Date of Patent: Jul. 14, 2026

(54) WATER TANK, VENTILATION AREA DESIGN METHOD THEREOF, STORAGE MEDIUM AND ELECTRONIC APPARATUS

(71) Applicant: Zhejiang University, Hangzhou (CN)

(72) Inventors: Yiyi Ma, Hangzhou (CN); Jialing Liang, Hangzhou (CN); Feifei Zheng, Hangzhou (CN); David Z. Zhu, Ningbo (CN); Hongwu Tang, Nanjing (CN); Saiyu Yuan, Nanjing (CN)

(73) Assignee: Zhejiang University, Hangzhou (CN)

( * ) Notice: Subject to any disclaimer, the term of this patent is extended or adjusted under 35 U.S.C. 154(b) by 171 days.

(21) Appl. No.: 18/593,993

(22) Filed: Mar. 4, 2024

(65) Prior Publication Data

US 2024/0208718 A1 Jun. 27, 2024

Related U.S. Application Data

(63) Continuation of application No. PCT/CN2023/095532, filed on May 22, 2023.

(30) Foreign Application Priority Data

Dec. 27, 2022 (CN) ..... 202211691513.2

(51) Int. Cl.
*B65D 90/22* (2006.01)

(52) U.S. Cl.
CPC ..... *B65D 90/22* (2013.01); *B65D 2205/00* (2013.01)

(58) Field of Classification Search
CPC ..... B65D 90/22; B65D 2205/00
See application file for complete search history.

(56) References Cited

U.S. PATENT DOCUMENTS 3,101,506 A * 8/1963 Himes ..... A47L 13/26 401/289
2016/0106270 A1* 4/2016 Beuhring ..... A47K 3/286 4/602

FOREIGN PATENT DOCUMENTS

| | | | |
|---|---|---|---|
| CN | 110158551 | A | 8/2019 |
| CN | 110197001 | A | 9/2019 |
| CN | 115809490 | A | 3/2023 |
| GB | 2266041 | A | 10/1993 |
| KR | 20020083723 | A | 11/2002 |

(Continued)

OTHER PUBLICATIONS

Yiyi Ma, <<Air Entrainment and Energy Dissipation in Drop Structures in Drainage System>>, China Doctoral Dissertation Full-Text Database, Engineering and Technology Series II (Monthly), Issue 02, Feb. 15, 2017 (Feb. 15, 2017), China.

(Continued)

*Primary Examiner* — P. Macade Nichols

(57) ABSTRACT

A drainage device, a water tank, a ventilation area design method thereof, and a storage medium and an electronic apparatus, wherein the top of the water tank is provided with a ventilation slit, an area of which is adjustable in real time, and the bottom of the water tank is provided with a drainage orifice. A determination model for determining whether bubbles are generated during a drainage process of the water tank is established, and a relationship between an area of the drainage orifice and that of the ventilation slit, which satisfies the condition of no bubble generation during the drainage process, is established on this basis.

8 Claims, 2 Drawing Sheets

(56) References Cited

FOREIGN PATENT DOCUMENTS

KR 102408641 B1 6/2022

OTHER PUBLICATIONS

Biao Huang, et al., <<Experimental study of geysers through a vent pipe connected to flowing sewers>>, Water Science and Technology, Issue 01, Dec. 31, 2018 (Dec. 31, 2018), China.
International Search Report of PCT/CN2023/095532 (Aug. 30, 2023).

* cited by examiner

WATER TANK, VENTILATION AREA DESIGN METHOD THEREOF, STORAGE MEDIUM AND ELECTRONIC APPARATUS

CROSS REFERENCE TO RELATED APPLICATIONS

This application is a continuation application of International Application No. PCT/CN2023/095532, filed on May 22, 2023, which is based upon and claims foreign priority to Chinese Patent Application No. 202211691513.2, filed on Dec. 27, 2022, the entire contents of which are incorporated herein by reference.

TECHNICAL FIELD

The present disclosure relates to the technical field of drainage device, in particular to a water tank, a ventilation area design method thereof, a storage medium and an electronic apparatus.

BACKGROUND

Water tanks are common water storage facilities in both daily life and industry. The drainage efficiency is always an important indicator for measuring the performance of water tanks. Generally, the drainage orifice of a water tank is provided at the bottom. When the drainage orifice at the bottom is opened, it will be affected by external atmospheric pressure in case of poor ventilation at the top of the water tank, and as a result, air will enter the water tank during drainage and go upward, and bubbles will be generated and enter the air chamber above the water surface, and thus the pressure balance inside and outside the water tank is maintained. While bubbles are generated, the drainage velocity of the water tank will be significantly reduced. However, if a ventilation slit is provided at the top of the water tank, the air inflow from the drainage orifice at the bottom can be reduced, and the drainage velocity can be enhanced accordingly. FIG. 3 shows the drainage velocity of the water tank under three different ventilation conditions. Since the inside of the water tank needs to be clean, the ventilation slit provided on the top of the water tank needs to be as small as possible, so that contamination inside the water tank can be avoided to the greatest extent. In the prior art, it is difficult to strike a balance between the area of the ventilation slit and the drainage efficiency when designing the ventilation slit for the water tank, namely, either the inside of the water tank will be easily contaminated when the ventilation slit on the top is too large, or the drainage efficiency of the water tank is low when there is no ventilation slit or when the ventilation slit is too small. Therefore, a method of designing a water tank ventilation slit is urgently needed, so as to achieve a balance between the area of the ventilation slit and the drainage efficiency.

SUMMARY

The object of the present disclosure is to provide a water tank, a ventilation area design method thereof, as well as a storage medium and an electronic apparatus, so as to solve the above problem raised in the background.

To achieve the above-mentioned object, the present disclosure adopts the following technical solution: a water tank, wherein a top of the water tank is provided with a ventilation slit, an area of which is adjustable in real time, and a bottom of the water tank is provided with a drainage orifice.

A ventilation area design method of the water tank, comprising the following steps:

S1: establishing a determination model for determining whether bubbles are generated during a drainage process;

S2: establishing a relationship between an area of the drainage orifice and an area of the ventilation slit, which satisfies a condition of no bubble generation during the drainage process; and S3: calculating a minimum area of the ventilation slit required for no bubble generation during the drainage process, and adjusting the area of the ventilation slit of the water tank for drainage.

Preferably, in S1, a critical condition for bubbles entering the water tank from the drainage orifice at the bottom is determined based on a force balance at the drainage orifice at the bottom of the water tank, which is expressed as:

$$P_1 + \rho_w g h + \frac{1}{2}\rho_w\left(\frac{dh}{dt}\right)^2 - P_s < P_{atm}$$

where $P_1$ is an air pressure (relative pressure) in a headspace of the water tank, Pa; $P_s$ is an additional pressure exerted at the drainage orifice by water surface tension, Pa, and a magnitude of the additional pressure can be determined based on an actual area of the drainage orifice of the water tank; $P_{atm}$ is a relative atmospheric pressure, Pa; $\rho_w$ is a density of water, kg/m$^3$; and g is acceleration of gravity, m/s$^2$.

Preferably, in S2, a relationship between the air pressure in the headspace of the water tank and a water depth during the drainage process is determined based on the mass conservation and energy conservation laws. Further referring to the above critical condition for bubbles entering the water tank via the drainage orifice at the bottom, a condition expression of no bubble generation is obtained:

$$\frac{-g\rho_w\rho_a(k_0+1)\varepsilon_0^2A_0^2}{\rho_w\varepsilon_s^2A_s^2\left(\zeta_0+1-\frac{\varepsilon_0^2A_0^2}{A_1^2}\right)+\rho_a(k_0+1)\varepsilon_0^2A_0^2}h + \rho_w g h + \frac{1}{2}\rho_w\left(\frac{dh}{dt}\right)^2 - P_s < P_{atm},$$

where $\zeta_0$ is a local head loss coefficient of the drainage orifice at the bottom and is dimensionless; $z_1$ and $z_2$ are position heads of the water surface inside the water tank and at the drainage orifice, m; $v_1$ and $v_2$ are average flow velocities of the water surface inside the water tank and a water surface at the drainage orifice, m/s; $\rho_a$ is air density, kg/m$^3$; $k_0$ is a local head loss coefficient of the ventilation slit and is dimensionless; h is a water depth in the water tank, and $\varepsilon_s$ is a contraction coefficient of the ventilation slit and is dimensionless; and $A_0$ is an area of the drainage orifice at the bottom of the water tank, and $A_s$ is an area of the ventilation slit at the top of the water tank.

Preferably, computer programs are stored in a storage medium, the computer programs comprising a sequence and program codes for controlling an execution process, the execution process including a ventilation area design method of the water tank under an insufficient ventilation condition.

Preferably, computer programs are stored in a memory, a processor runs the computer programs, and a display module is used for outputting a calculation result.

The advantageous effects of the present disclosure are as follows.

1. In the present disclosure, a determination model for determining whether bubbles are generated during a drainage process is established, and a relationship between an area of the drainage orifice and that of the ventilation slit, which satisfies the condition of no bubble generation during the drainage process, is established on this basis, thereby obtaining a reasonable design range of the ventilation slit, and then a reasonable area of the ventilation slit is selected according to the actual needs of the ventilation slit of the water tank. Therefore, the designed area of the ventilation slit not only can ensure the drainage efficiency but also can prevent the inside of the water tank from being contaminated by external environment to the greatest extent, thereby achieving a reasonable balance therebetween, which provides a novel idea for the design of water tanks and is of great significance.
2. In the present disclosure, the design method and the program codes of process conversion are integrated into the electronic apparatus or the storage medium, which simplifies the application and liberates designers from manual calculations. The present disclosure allows the area of the ventilation slit to be designed according to specific conditions and leads to a higher design efficiency while less design errors.

BRIEF EXPLANATION OF THE REFERENCE NUMERALS

Figure 1:
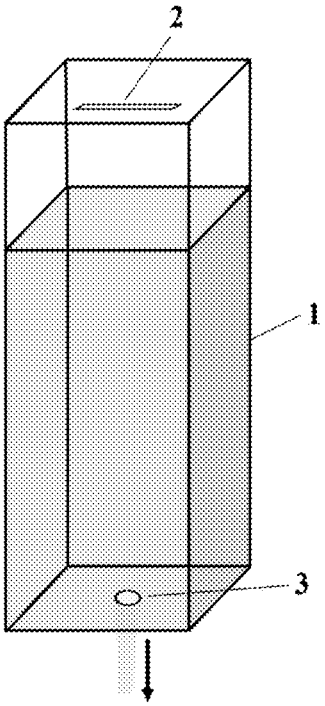
FIG. 1 is a diagram showing an appearance of the water tank according to the present disclosure.
Figure 2:
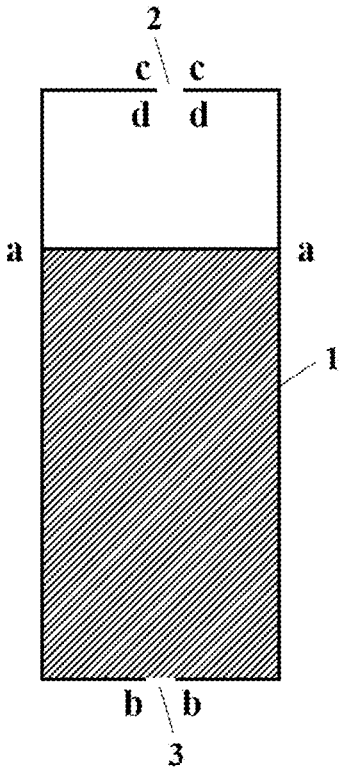
FIG. 2 is a diagram showing a sectional model of the water tank according to the present disclosure.
Figure 3:
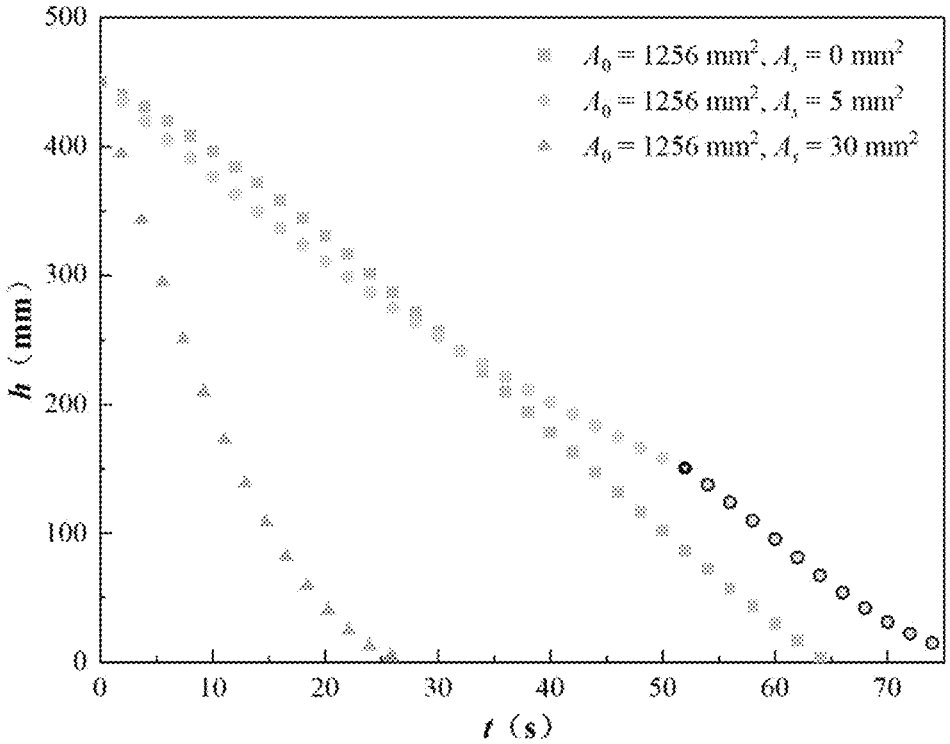
FIG. 3 is a diagram showing the drainage efficiency of the water tank under three different ventilation conditions.

1. Water tank; 2. Ventilation slit; 3. Drainage orifice.

DETAILED DESCRIPTION OF THE EMBODIMENTS

With reference to the drawings of the embodiments of the present disclosure, the technical solutions of the embodiments of the present disclosure will be clearly and completely described below. Apparently, the embodiments described here are merely part of the embodiments of the present disclosure, rather than all of them. Based on the embodiments of the present disclosure, any other embodiments obtained by ordinary technicians in this field without paying creative efforts fall within the scope of protection of the present disclosure.

As shown in FIGS. 1 to 4, an embodiment of the present disclosure provides a water tank, and a ventilation area design method and use thereof. Firstly, considering the influence of bubbles from the bottom drainage orifice on the drainage process, a condition for determining whether bubbles are generated in the drainage process is established. Based on the force balance at the bottom orifice of the water tank, a critical condition for bubbles entering the water tank is expressed as:

$$P_1 + \rho_w g h + \frac{1}{2}\rho_w\left(\frac{dh}{dt}\right)^2 - P_s < P_{atm}, \tag{1}$$

where $P_1$ is an air pressure (relative pressure) in the headspace of the water tank, Pa; $P_s$ is an additional pressure exerted at the bottom drainage orifice by water surface tension, Pa, and a magnitude of the additional pressure can be determined based on an actual area of the drainage orifice of the water tank; $P_{atm}$ is a relative atmospheric pressure, Pa; $\rho_w$ is a density of water, kg/m$^3$; and g is acceleration of gravity, m/s$^2$.

Secondly, a relationship between the area of the drainage orifice and that of the ventilation slit, which satisfies the condition of no bubble generation during the drainage process, is established. Based on the mass conservation and energy conservation equations, an equation for the air pressure variation with the water depth in the headspace of the water tank during the drainage process is deducted according to the steps below.

Suppose that a value of change in water depth in the water tank within a very short time period of dt is denoted as dh and that the outflow velocity at the bottom drainage orifice is $v_2$, the Bernoulli equation is then established according to the energy conservation law between an air-water interface a-a inside the water tank and an outer interface b-b below the bottom drainage orifice of the water tank:

$$z_1 + \frac{P_1}{\rho_w g} + \frac{v_1^2}{2g} = z_2 + \frac{P_2}{\rho_w g} + (\zeta_0 + 1)\frac{v_2^2}{2g}, \tag{2}$$

where $P_1$ is an air pressure (relative pressure) in the headspace of the water tank, Pa; $P_2=0$ is a pressure at the interface b-b, Pa, which is approximately equal to atmospheric pressure (relative pressure); $\zeta_0$ is a local head loss coefficient of the drainage orifice at the bottom and is dimensionless; $z_1$ and $z_2$ are position heads at the interfaces a-a and b-b, m; and $v_1$ and $v_2$ are average flow velocities at the interfaces a-a and b-b, m/s.

According to the law of conservation of mass, a continuity equation between the interfaces a-a and b-b can be expressed as:

$$v_1 A_1 = v_2 A_2, \tag{3}$$

where $A_1$ is a cross-section area of the water tank, m$^2$; and $A_2$ is a contraction cross-section area at the interface b-b, m$^2$.

The contraction cross-section area $A_2$ can be calculated using the equation:

$$A_2 = \varepsilon_0 A_0, \tag{4}$$

where $\varepsilon_0$ is the contraction coefficient of the bottom drainage orifice and is dimensionless; and $A_0$ is the area of the bottom drainage orifice of the water tank, m$^2$.

Suppose that the airflow velocity passing through the ventilation slit on the top is $v_a$, and that the position head at an interface c-c is close to that at d-d, the Bernoulli equation can be written for inner and outer interfaces c-c and d-d of the ventilation slit on the top of the water tank according to the law of conservation of energy, as:

$$\frac{P_3}{\rho_a g} = \frac{P_4}{\rho_a g} + (k_0 + 1)\frac{v_a^2}{2g}, \tag{5}$$

where $P_3=0$ is the pressure at the interface c-c, which is approximately equal to the standard atmospheric pressure (relative pressure), Pa; $P_4$ is the pressure at the interface d-d, i.e. the air pressure in the headspace of the water tank, Pa; $\rho_a$ is air density, kg/m$^3$; and $k_0$ is a local head loss coefficient of the ventilation slit and is dimensionless.

Within a time period of dt, a volume $dV_w$ of liquid flowing out via the bottom drainage orifice of the water tank can be calculated by the following equation:

$$dV_w = Q_w dt = \varepsilon_0 A_0 v_2 dt = \varepsilon_0 A_0 \sqrt{\frac{2gh + \frac{2P_1}{\rho_w}}{\zeta_0 + 1 - \frac{\varepsilon_0^2 A_0^2}{A_1^2}}}\, dt. \tag{6}$$

Here $v_2$ can be obtained in the following steps: substituting Equation (4) into Equation (3) to obtain the relationship between $v_1$ and $v_2$, then substituting this relationship into Equation (2) to derive the relationship between $v_2$ and $P_1$. The relationship between $v_2$ and $P_1$ is then applied to Equation (6).

It is assumed that, within the same time period of dt, a volume $dV_a$ of air entering the water tank through the ventilation slit on the top of the water tank can be calculated by the following equation:

$$dV_a = Q_a dt = \varepsilon_s A_s v_a dt = \varepsilon_s A_s \sqrt{\frac{-2P_1}{\rho_a(k_0 + 1)}}\, dt, \tag{7}$$

where $\varepsilon_s$ is the contraction coefficient of the ventilation slit and is dimensionless, and $v_a$ can be derived from Equation (4).

It is assumed that the volume $dV_w$ of liquid flowing out of the water tank in a very short time period of dt is equal to the volume $dV_a$ of air entering the water tank, namely, $$dV_a = dV_w. \tag{8}$$

By substituting Equation (6) and Equation (7) into Equation (8), the relationship between the air pressure $P_1$ at the headspace of the water tank and the water depth h during the drainage process can be obtained as:

where $$P_1 = Kh, \tag{9-1}$$

$$K = \frac{-g\rho_w\rho_a(k_0 + 1)\varepsilon_0^2 A_0^2}{\rho_w\varepsilon_s^2 A_s^2\left(\zeta_0 + 1 - \frac{\varepsilon_0^2 A_0^2}{A_1^2}\right) + \rho_a(k_0 + 1)\varepsilon_0^2 A_0^2}. \tag{9-2}$$

Combining Equation (1) with Equation (9), an expression of condition for no bubble generation can be obtained, which is:

$$\frac{-g\rho_w\rho_a(k_0 + 1)\varepsilon_0^2 A_0^2}{\rho_w\varepsilon_s^2 A_s^2\left(\zeta_0 + 1 - \frac{\varepsilon_0^2 A_0^2}{A_1^2}\right) + \rho_a(k_0 + 1)\varepsilon_0^2 A_0^2} h + \rho_w g h + \frac{1}{2}\rho_w\left(\frac{dh}{dt}\right)^2 - P_s < P_{atm}. \tag{10}$$

Specifically, when the area $A_0$ of the drainage orifice at the bottom of the water tank and the area $A_s$ of the ventilation slit satisfy the relationship of Equation (10), it can be ensured that no bubbles will be generated at the bottom during the drainage process of the water tank. When the drainage process ends, there is still 10 mm of water remaining in the water tank. Therefore, if the left side of Equation (10) equals to the right side when h=10 mm, the corresponding value of $A_s$ can be considered as the minimum value of the ventilation area required for no bubble generation during the drainage process.

As for this experiment, it is known that: g=9.8 m/s$^2$, $\rho_w$=1000 kg/m$^3$, $\rho_a$=1.29 kg/m$^3$, $k_0$=0.06, $\varepsilon_0$=0.64, $\varepsilon_s$=0.64, $\zeta_0$=0.06, $A_1$=0.04 m$^2$, $A_0$=1.256×10$^{-3}$ m$^2$, $P_s$=20 Pa, $P_{atm}$=0 Pa, and h=0.01 m. The value of $$\frac{1}{2}\rho_w\left(\frac{dh}{dt}\right)^2$$

is so small that it can be neglected. Substituting the above known parameters into Equation (10), it is obtained that no bubbles are generated only when the area $A_s$ of the ventilation slit satisfies the condition of $A_s \geq 2.36\times10^{-5}$ m$^2$=23.6 mm$^2$. In actual use of a water tank, the smaller the area of the ventilation slit is, the lower the risk of water being contaminated by the outside is. Therefore, a small area $A_s$=30 mm$^2$ is taken into consideration, and experiments of drainage are conducted based on this area of the ventilation slit. According to the experimental results, the emptying time is 25.6 s, which is greatly improved relative to the efficiencies when $A_s$=0 mm$^2$ and $A_s$=5 mm$^2$. Therefore, this calculation method is feasible to guide the design of the ventilation area of the water tank.

Further, an equation for calculating the drainage efficiency under insufficient ventilation conditions is established. It is assumed that a value of change in the water depth inside the water tank is dh within a time period of dt, $v_1$ in Equation (2) can be expressed as $$v_1 = \frac{dh}{dt}. \tag{11}$$

Substituting Equations (3), (4) and (11) into Equation (2), the equation below is derived:

$$\rho_w gh + P_1 = \frac{\rho_w}{2}\left[\frac{A_1^2}{\varepsilon_0^2 A_0^2}(\zeta_0 + 1) - 1\right]\left(\frac{dh}{dt}\right)^2. \tag{12}$$

Substituting Equation (9) into Equation (12), a differential equation expression of the value dh of change of water depth in the water tank within a very short time period of dt can be obtained:

$$Mdt = \frac{1}{\sqrt{h}}dh, \tag{13-1}$$

where $$M = \sqrt{\frac{(\rho_w g + K)}{\frac{\rho_w}{2}\left[\frac{A_1^2}{\varepsilon^2 A_0^2}(\zeta_0 + 1) - 1\right]}}. \tag{13-2}$$

A calculation formula of water depth change over time and the time required for draining the water tank can be obtained by the selection of different integral domains for integration. Specifically, when the integral domain on the left of Equation (13-1) is set as [0, t] and the integral domain on the right is set as [$H_0$, h], the calculation formula of water depth change over time in the water tank during the drainage process can be obtained via integration:

$$h = \frac{M^2}{4}t^2 - \sqrt{H_0}\,Mt + H_0, \tag{14}$$

where $H_0$ is the initial water depth in the water tank, m; and when the integral domain on the left of Equation (13-1) is set as [0, $T_e$], and the integral domain on the right is set as [$H_0$, 0], a time $T_e$ required for draining the water tank can be obtained via integration:

$$T_e = \frac{2\sqrt{H_0}}{M}. \tag{15}$$

Figure 4:
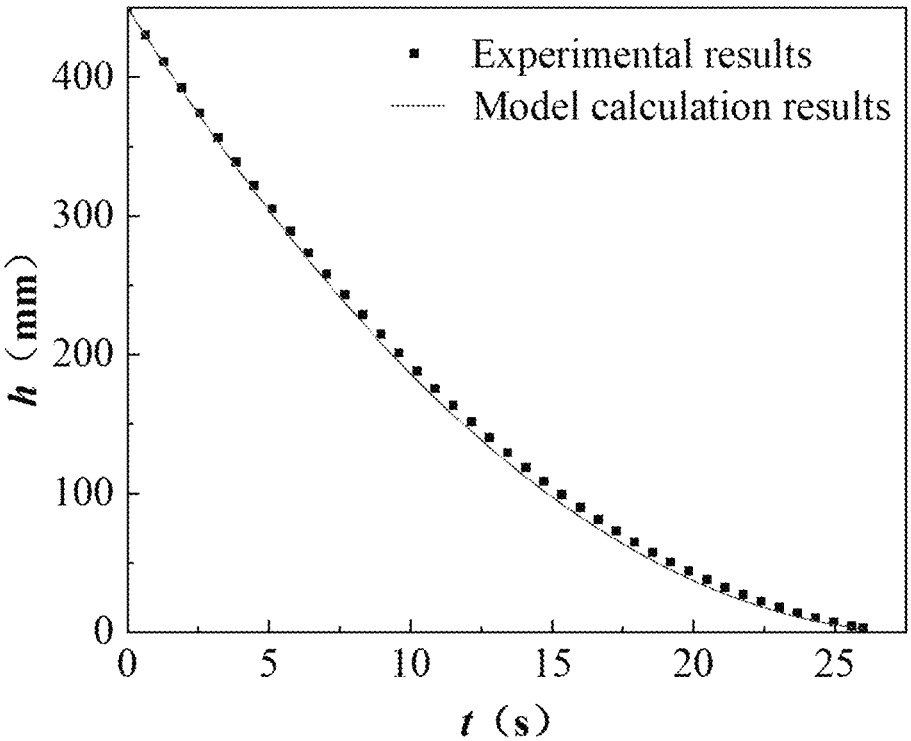
FIG. 4 is a comparison diagram of the experimental and modeling results of the present disclosure.

FIG. 4 shows the comparison between the model calculation results and the experimental results, which are in good agreement. This indicates that the prediction model is feasible.

The design method described in the above embodiments can be integrated into a related apparatus, such as a storage medium, in which computer programs are stored. The computer programs comprise a sequence and program codes for controlling an execution process, and the execution process comprises the three fundamental steps outlined in the aforementioned embodiments:

S1: establishing a determination model for determining whether bubbles are generated during a drainage process;

S2: establishing a relationship between an area of the drainage orifice and an area of the ventilation slit, which satisfies a condition of no bubble generation during the drainage process; and S3: calculating a minimum area of the ventilation slit required for no bubble generation during the drainage process, and adjusting the area of the ventilation slit of the water tank for drainage.

The storage medium is not limited to a hard disk, a flash memory, etc., and can call the above-mentioned design steps along with basic algorithms when connected to a computer, so as to determine the size of the ventilation slit in a construction site or a drainage site, which is flexible, adaptable and applicable in a wide range. Based on existing storage media, it offers plug and play functionality, and saves labor cost and time cost of manual designs and calculations in the office.

According to another aspect of the present disclosure, an electronic apparatus is provided, which has several basic modules such as a memory, a processor, an input module, and a display module. In the memory of the electronic apparatus, the above basic steps of designing the ventilation slit and algorithm process are stored. The processor is configured to perform the above design steps and algorithms. Users can input relevant parameters of the site or the water tank to be designed via the input module, and the display module can output the design results after calculation. The apparatus is professionally used in this field and is well adaptive. Since the apparatus can work independently, it offers better performance in stability and can be designed in lightweight. For example, a handheld computer, a smart watch, etc., can all carry out the design of the present disclosure.

It should be noted that, relationship terms in this text, such as first and second, are used only to distinguish one substance or operation from another, and do not necessarily require or imply any actual relationship or order between these substances or operations. Furthermore, the terms "comprise", "include" or any other variations thereof are intended to cover non-exclusive inclusion, so that a process, method, article or apparatus comprising a set of elements includes not only those elements, but also other elements that are not expressly listed, or elements inherent to such process, method, article or apparatus.

Although embodiments of the present disclosure have been shown and described, it can be understood by an ordinary technician in this field that these embodiments may be varied, amended, replaced and modified in many ways without deviating from the principle and spirit of the present disclosure, and that the scope of the present disclosure is limited by the attached claims and equivalents thereof.

The invention claimed is:

1. A ventilation area design method for a water tank, comprising the steps of:

S1: establishing a determination model for determining whether bubbles are generated during a drainage process;

S2: establishing a relationship between an area of a drainage orifice and an area of a ventilation slit of the water tank, which satisfies a condition of no bubble generation during the drainage process; and S3: calculating a minimum area of the ventilation slit required for no bubble generation during the drainage process, and adjusting the area of the ventilation slit of the water tank for drainage.

2. The ventilation area design method of the water tank according to claim 1, wherein in S1, a critical condition for bubbles entering the water tank via the drainage orifice at the bottom is determined based on a force balance at the drainage orifice at the bottom of the water tank, which is expressed as:

$$P_1 + \rho_w gh + \frac{1}{2}\rho_w\left(\frac{dh}{dt}\right)^2 - P_s < P_{atm};$$

where $P_1$ is an air pressure (relative pressure) in a headspace of the water tank, Pa; $P_s$ is an additional pressure exerted at the drainage orifice by surface tension, Pa, and a magnitude of the additional pressure is determined based on an actual size of the drainage orifice of the water tank; $P_{atm}$ is a relative atmospheric pressure, Pa; $\rho_w$ is a density of water, kg/m$^3$; and g is acceleration of gravity, m/s$^2$.

3. The ventilation area design method of the water tank according to claim 1, wherein in S2, a relationship between an air pressure in a headspace of the water tank and a water depth during the drainage process is determined based on mass conservation and energy conservation laws, and based on a critical condition for bubbles entering the water tank via the drainage orifice at the bottom, a condition expression of no bubble generation is obtained:

$$\frac{-g\rho_w\rho_a(k_0+1)\varepsilon_0^2A_0^2}{\rho_w\varepsilon_s^2A_s^2\left(\zeta_0+1-\frac{\varepsilon_0^2A_0^2}{A_1^2}\right)+\rho_a(k_0+1)\varepsilon_0^2A_0^2}h + \rho_w gh + \frac{1}{2}\rho_w\left(\frac{dh}{dt}\right)^2 - P_s < P_{atm},$$

where $\zeta_0$ is a local head loss coefficient of the drainage orifice at the bottom and is dimensionless; $z_1$ and $z_2$ are position heads of a water surface inside the water tank and at the drainage orifice, m; $v_1$ and $v_2$ are average flow velocities of the water surface inside the water tank and a water surface at the drainage orifice, m/s; $\rho_a$ is air density, kg/m$^3$; $k_0$ is a local head loss coefficient of the ventilation slit and is dimensionless; h is a water depth in the water tank, and $\varepsilon_s$ is a contraction coefficient of the ventilation slit and is dimensionless; and $A_0$ is an area of the drainage orifice at the bottom of the water tank, and $A_s$ is an area of the ventilation slit at the top of the water tank.

4. A storage medium, wherein computer programs are stored in the storage medium, the computer programs comprising a sequence and program codes for controlling an execution process, the execution process comprising a ventilation area design method for a water tank, and the ventilation area design method comprises:

S1: establishing a determination model for determining whether bubbles are generated during a drainage process;

S2: establishing a relationship between an area of a drainage orifice and an area of a ventilation slit of the water tank, which satisfies a condition of no bubble generation during the drainage process; and S3: calculating a minimum area of the ventilation slit required for no bubble generation during the drainage process, and adjusting the area of the ventilation slit of the water tank for drainage.

5. An electronic apparatus, comprising: a memory, a processor, and a display module, wherein the memory has a storage medium, the processor runs computer programs stored in the storage medium, and the display module outputs a calculation result, wherein the computer programs comprises a sequence and program codes for controlling an execution process, the execution process comprises a ventilation area design method for a water tank, and the ventilation area design method comprises:

S1: establishing a determination model for determining whether bubbles are generated during a drainage process;

S2: establishing a relationship between an area of a drainage orifice and an area of a ventilation slit of the water tank, which satisfies a condition of no bubble generation during the drainage process; and S3: calculating a minimum area of the ventilation slit required for no bubble generation during the drainage process, and adjusting the area of the ventilation slit of the water tank for drainage.

6. A storage medium, wherein computer programs are stored in the storage medium, the computer programs comprising a sequence and program codes for controlling an execution process, the execution process comprising a ventilation area design method for a water tank, and the ventilation area design method comprises:

S1: establishing a determination model for determining whether bubbles are generated during a drainage process, wherein a critical condition for bubbles entering the water tank via the drainage orifice at the bottom is determined based on a force balance at the drainage orifice at the bottom of the water tank, which is expressed as:

$$P_1 + \rho_w gh + \frac{1}{2}\rho_w\left(\frac{dh}{dt}\right)^2 - P_s < P_{atm};$$

where $P_1$ is an air pressure (relative pressure) in a headspace of the water tank, Pa; $P_s$ is an additional pressure exerted at the drainage orifice by surface tension, Pa, and a magnitude of the additional pressure is determined based on an actual size of the drainage orifice of the water tank; $P_{atm}$ is a relative atmospheric pressure, Pa; $\rho_w$ is a density of water, kg/m$^3$; and g is acceleration of gravity, m/s$^2$;

S2: establishing a relationship between an area of a drainage orifice and an area of a ventilation slit of the water tank, which satisfies a condition of no bubble generation during the drainage process; and S3: calculating a minimum area of the ventilation slit required for no bubble generation during the drainage process, and adjusting the area of the ventilation slit of the water tank for drainage.

7. A storage medium, wherein computer programs are stored in the storage medium, the computer programs comprising a sequence and program codes for controlling an execution process, the execution process comprising a ventilation area design method for a water tank, and the ventilation area design method comprises:

S1: establishing a determination model for determining whether bubbles are generated during a drainage process;

S2: establishing a relationship between an area of a drainage orifice and an area of a ventilation slit of the water tank, which satisfies a condition of no bubble generation during the drainage process, wherein a relationship between an air pressure in a headspace of the water tank and a water depth during the drainage process is determined based on mass conservation and energy conservation laws, and based on a critical condition for bubbles entering the water tank via the drainage orifice at the bottom, a condition expression of no bubble generation is obtained:

$$\frac{-g\rho_w\rho_a(k_0+1)\varepsilon_0^2A_0^2}{\rho_w\varepsilon_0^2A_0^2\left(\zeta_0+1-\frac{\varepsilon_0^2A_0^2}{A_1^2}\right)+\rho_a(k_0+1)\varepsilon_0^2A_0^2}h+\rho_w gh+\frac{1}{2}\rho_w\left(\frac{dh}{dt}\right)^2-P_s<P_{atm},$$

where $\zeta_0$ is a local head loss coefficient of the drainage orifice at the bottom and is dimensionless; $z_1$ and $z_2$ are position heads of a water surface inside the water tank and at the drainage orifice, m; $v_1$ and $v_2$ are average flow velocities of the water surface inside the water tank and a water surface at the drainage orifice, m/s; $\rho_a$ is air density, kg/m$^3$; $k_0$ is a local head loss coefficient of the ventilation slit and is dimensionless; h is a water depth in the water tank, and $\varepsilon_s$ is a contraction coefficient of the ventilation slit and is dimensionless; and $A_0$ is an area of the drainage orifice at the bottom of the water tank, and $A_s$ is an area of the ventilation slit at the top of the water tank; and S3: calculating a minimum area of the ventilation slit required for no bubble generation during the drainage process, and adjusting the area of the ventilation slit of the water tank for drainage.

8. A water tank, comprising:

a ventilation slit located at a top of the water tank; and a drainage orifice located at a bottom of the water tank, wherein the water tank is applicable for a ventilation area design method comprising:

S1: establishing a determination model for determining whether bubbles are generated during a drainage process;

S2: establishing a relationship between an area of the drainage orifice and an area of the ventilation slit, which satisfies a condition of no bubble generation during the drainage process; and S3: calculating a minimum area of the ventilation slit required for no bubble generation during the drainage process, and adjusting the area of the ventilation slit of the water tank for drainage.

* * * * *